US008998382B2

(12) United States Patent
Freriks et al.

(10) Patent No.: US 8,998,382 B2
(45) Date of Patent: Apr. 7, 2015

(54) DROPLET EJECTION DEVICE

(71) Applicant: Oce-Technologies B.V., Venlo (NL)

(72) Inventors: Hendrikus J. M. Freriks, Venlo (NL); Hans Reinten, Velden (NL); Marcus J. Van Den Berg, Venlo (NL); Igor Shklyarevskiy, Nijmegen (NL); Klaas Verzijl, Well (NL); Ronald Berkhout, Maasbree (NL)

(73) Assignee: Oce-Technologies B.V., Venlo (NL)

( * ) Notice: Subject to any disclaimer, the term of this patent is extended or adjusted under 35 U.S.C. 154(b) by 0 days.

(21) Appl. No.: 14/243,090

(22) Filed: Apr. 2, 2014

(65) Prior Publication Data

US 2014/0210910 A1 Jul. 31, 2014

Related U.S. Application Data

(63) Continuation of application No. PCT/EP2012/069078, filed on Sep. 27, 2012.

(30) Foreign Application Priority Data

Oct. 3, 2011 (EP) ..... 11183677

(51) Int. Cl.
*B41J 2/14* (2006.01)
*B41J 2/16* (2006.01)

(52) U.S. Cl.
CPC ..... *B41J 2/1433* (2013.01); *B41J 2/14233* (2013.01); *B41J 2/161* (2013.01); *B41J 2/1628* (2013.01); *B41J 2/1629* (2013.01); *B41J 2202/11* (2013.01); *B41J 2202/12* (2013.01)

(58) Field of Classification Search
CPC ..... B41J 2/14; B41J 2/1404; B41J 2/06; B41J 2/16
USPC ..... 347/47, 55
See application file for complete search history.

(56) References Cited

U.S. PATENT DOCUMENTS

| | | | | |
|---|---|---|---|---|
| 6,488,359 | B2 * | 12/2002 | Silverbrook | 347/54 |
| 2008/0088669 | A1 | 4/2008 | Shimura | |
| 2008/0158304 | A1 | 7/2008 | Eto | |
| 2010/0194800 | A1 | 8/2010 | Hong et al. | |
| 2010/0328403 | A1 | 12/2010 | Xie et al. | |

FOREIGN PATENT DOCUMENTS

| | | | |
|---|---|---|---|
| EP | 1518680 | A1 | 3/2005 |
| EP | 1518680 | A1 * | 3/2005 |
| JP | 6-31915 | A | 2/1994 |
| JP | 11-138815 | A | 5/1999 |

* cited by examiner

*Primary Examiner* — Alessandro Amari
*Assistant Examiner* — Michael Konczal
(74) *Attorney, Agent, or Firm* — Birch, Stewart, Kolasch & Birch, LLP

(57) ABSTRACT

A droplet ejection device comprising a flow passage, a nozzle orifice formed in a wall of the flow passage, a circulation system for circulating a liquid through the flow passage, and an actuator system for generating a pressure wave in the liquid in the flow passage, wherein an obstruction member is arranged in the flow passage in a position opposite to the nozzle orifice and projecting towards the nozzle orifice.

5 Claims, 3 Drawing Sheets

DROPLET EJECTION DEVICE

CROSS REFERENCE TO RELATED APPLICATIONS

This non-provisional application is a Continuation of International Application No. PCT/EP2012/069078 filed on Sep. 27, 2012, which claims the benefit of European Application No. 11183677.1 filed in European on Oct. 03, 2011. The entire contents of all of the above applications are hereby incorporated by reference.

The invention relates to a droplet ejection device comprising a flow passage, a nozzle orifice formed in a wall of the flow passage, a circulation system for circulating a liquid through the flow passage, and an actuator system for generating a pressure wave in the liquid in the flow passage.

Droplet ejection devices are used for example in ink jet printers for ejecting ink droplets onto a recording medium. The actuator system may for example comprise a piezoelectric actuator that, when energized, performs a contraction stroke followed by an expansion stroke so as to generate an acoustic pressure wave in the ink. The pressure wave propagates in the flow passage and reaches the nozzle orifice, so that an ink droplet is ejected from the nozzle orifice.

US 2010/328403 A2 discloses a droplet ejection device of the type indicated above. This device is configured as a so-called through-flow device wherein the circulation system maintains a constant flow of liquid through the flow passage. This has the advantage that the flow passage is scavenged with the liquid so that any possible contaminants that may be contained in the liquid are prevented from being deposited on the walls of the flow passage or the nozzle orifice and are removed with the flow of the liquid. Likewise, the flow of liquid helps to remove air bubbles that could compromise the generation of the pressure wave and the ejection of the droplet. Moreover, the constant flow of liquid reduces the risk that the nozzle orifice dries out.

It is an object of the invention to provide a through-flow droplet ejection device which has an improved flow pattern.

According to the invention, an obstruction member is arranged in the flow passage in a position opposite to the nozzle orifice and projecting towards the nozzle orifice. The position opposite to the nozzle orifice is defined as the obstruction member facing the nozzle orifice and extending transversely to the flow passage over at least a width of the nozzle orifice, more preferably the obstruction member is substantially extending transversely over a width of the flow passage.

The liquid flowing through the flow passage is forced to flow around the obstruction member, and since this obstruction member projects towards the nozzle orifice over at least a width of the nozzle orifice, the through flow velocity of the liquid along the nozzle orifice is increased in the immediate vicinity of the nozzle orifice. As used herein, the obstruction member is substantially extending transversely over a width of the flow passage, if the obstruction member is directing the flow in the flow passage such that the through flow pattern is mainly forced along the nozzle orifice in the immediate vicinity of the nozzle orifice. This improves the efficiency with which contaminants and air bubbles can be removed, especially in the vicinity of the nozzle orifice where such contaminants and air bubbles would be particularly disturbing. The high flow velocity of the liquid along the nozzle orifice also reduces the tendency of the nozzle orifice to dry out. In particular the through flow along the nozzle orifice is benificial during a standby period of the droplet ejection device, when the actuator system is not generating a pressurre wave in the flow passage and no droplets are ejected from the nozzle orifice.

More specific optional features of the invention are indicated in the dependent claims.

The nozzle orifice may be formed at an end of a funnel or nozzle passage that branches-off from the flow passage. The obstruction member projects towards the nozzle orifice and may extend through the nozzle passage or funnel. In this embodiment the projection of the obstruction member substantially extends transversely to the flow passage over a width of the nozzle passage in order to support a through flow through the funnel or nozzle passage. As such a high through flow velocity of the liquid in the vicinity of the nozzle orifice may be obtained even when the distance between the nozzle orifice and the point where the funnel or nozzle passage branches-off from the flow passage is relatively large. Such a configuration has the advantage that the nozzle orifice and the funnel or nozzle passage may be formed in a relatively thick and rigid nozzle plate which will not yield when a pressure wave is generated in the liquid. In a particularly convenient configuration, the nozzle plate may delimit a pressure chamber, where the actuator acts upon the liquid, or an actuator chamber accommodating the actuator.

A funnel converging towards the nozzle orifice has the further advantage that it reduces the risk that air bubbles are sucked-in through the nozzle orifice when the device has fired.

Preferred embodiments of the invention will now be described in conjunction with the drawings, wherein.

Figure 1:
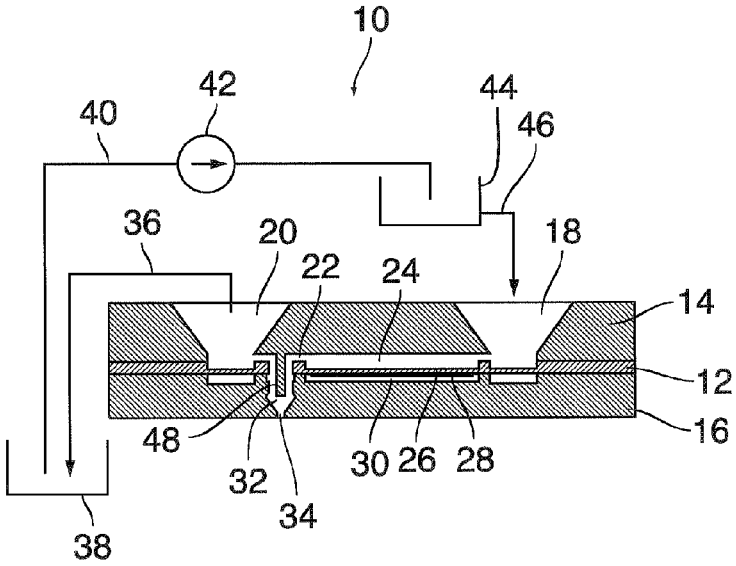
FIG. 1 is a schematic cross-sectional view of a droplet ejection device according to an embodiment of the invention.

FIG. 1 shows a droplet ejection device 10 that is formed by a MEMS (Micro-Electro-Mechanical System). The device comprises a membrane wafer 12 sandwiched between an ink distribution wafer 14 and a nozzle plate 16.

The ink distribution wafer 14 has an ink inlet groove 18 and an ink outlet groove 20 which communicate with one another via a flow passage 22 that extends along a top surface of the membrane wafer 12. The membrane wafer 12 is recessed to form an enlarged pressure chamber 24 in an intermediate portion of the flow passage 22. The bottom of the pressure chamber 24 is formed by a thin part of the membrane wafer 12 which forms a flexible membrane 26. A sheet-like actuator 28, e.g. a bending mode piezoelectric PZT actuator, is attached to the bottom surface of the membrane 26 and accommodated in a recess 30 of the nozzle plate 16.

In a position between the pressure chamber 24 and the ink outlet groove 20 the membrane wafer 12 and nozzle plate 16 are perforated by a nozzle passage 32 that branches-off from the flow passage 22 and converges towards a nozzle orifice 34 in the bottom surface of the nozzle plate 16.

An ink discharge line 36 connects the outlet groove 20 to a sump 38 where the ink discharged from the outlet groove 20 is collected. An ink circulation system comprises an ink recovery line 40 and a pump 42 for recirculating the ink from the sump 38 to an ink reservoir 44 from which it may flow out into the ink inlet groove 18 via a feed line 46. In this way, a constant flow of ink through the flow passage 22 is maintained. Note that in another embodiment, the sump 38 may be omitted. Hence, in such embodiment, the ink may be circulated directly from the outlet groove 20 via the pump 42 to the ink reservoir 44.

In the illustrated embodiment, the ink distribution wafer 14 comprises an obstruction member 48 that projects downwardly from a top wall of the flow passage 22 into the nozzle passage 32 and towards the nozzle orifice 34. Thus, the ink flowing through the flow passage 22 is forced to flow around the obstruction member 48, so that a flow of ink is created in the immediate vicinity of the nozzle orifice 34 at the bottom end of the obstruction member 48. As a result, any contaminants or air bubbles that have got caught in the nozzle passage 32 and/or the nozzle orifice 34 are efficiently removed from the vicinity of the nozzle orifice.

As long as the actuator 28 does not fire, the surface tension of the ink is sufficient for preventing the ink from leaking out through the nozzle orifice 34. Although a certain amount of liquid may evaporate through the nozzle orifice, the intense flow of the liquid in the vicinity of this orifice assures that the liquid forming the meniscus in the nozzle orifice 34 is replaced relatively rapidly, so that the ink will not dry out in the nozzle orifice.

When an ink droplet is to be generated, the actuator 28 is energized and is thereby caused to bend so that the membrane 26 will flex. In a first stroke, ink may be sucked into the pressure chamber 24 from the inlet groove 18 (and possibly to some extent also from the outlet groove 20 depending on a number of design properties). During a second stroke, the ink in the pressure chamber 24 may be set under pressure, so that a pressure wave propagates through the flow passage 22 and the nozzle passage 32 to the nozzle orifice 34, such that an ink droplet will be ejected. In the shown embodiment, the obstruction member 48 may assist to direct the acoustic pressure wave towards the nozzle orifice and possibly even to reduce the dissipation of acoustic energy into the outlet groove 20.

Figure 2:
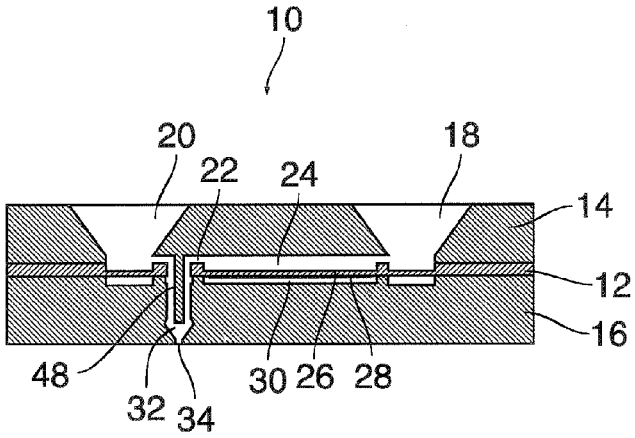
FIG. 2 shows a device according to another embodiment of the invention.

FIG. 2 illustrates an embodiment which differs from the embodiment shown in FIG. 1 in that the thickness of the nozzle plate 16 has been increased. In this embodiment, the nozzle plate 16 has a higher rigidity so that it can better withstand the forces that are created by the bending deformation of the actuator 28 and the membrane 26 and by the pressure of the ink in the pressure chamber 24. The length of the obstruction member 48 has been increased accordingly, so that a high flow velocity of the ink in the vicinity of the nozzle orifice 34 can still be assured.

Figure 3:
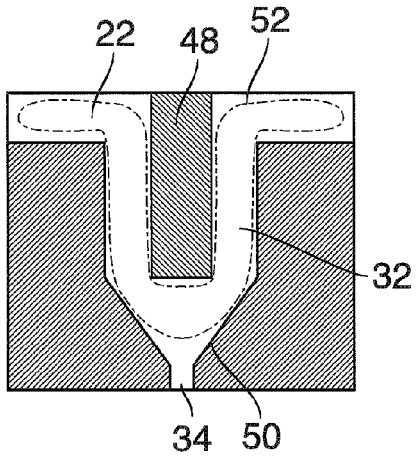
FIGS. 3 and 4 are enlarged cross-sectional views of droplet ejection devices according to further embodiments of the invention.

FIG. 3 is an enlarged cross-sectional view of the nozzle passage 32, the nozzle orifice 34 and the obstruction member 48. It can be seen here that the bottom part of the nozzle passage 32 is configured as a funnel 50 that converges toward the straight nozzle orifice 34. This funnel configuration helps to avoid that air bubbles are sucked in through the nozzle orifice 34 when the liquid pressure decreases after a droplet has been ejected.

A phantom line 52 indicates an area in the flow passage 22 and the nozzle passage 32 where the flow velocity of the ink that flows continuously through the flow passage 22 is significantly increased. It can be seen that, thanks to the obstruction member 48, the area of increased flow velocity comes very close to the nozzle orifice 34.

Figure 4:
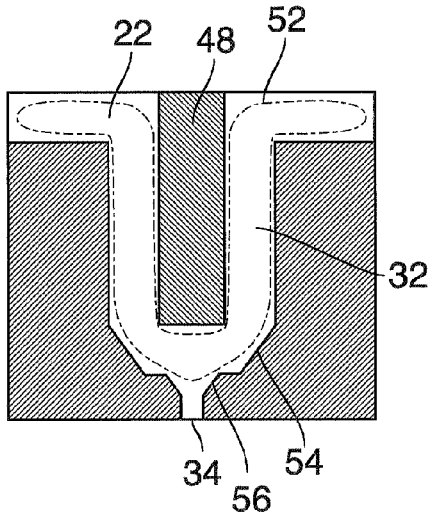

FIG. 4 shows a modified embodiment wherein the bottom portion of the nozzle passage 32 has a cross-sectional shape of a trapezoid 54 and a smaller funnel 56 is formed in the bottom wall of the trapezoid and connects the nozzle passage 32 to the straight nozzle orifice 34. This embodiment also permits to prevent air bubbles from being sucked-in through the nozzle orifice 34 as long as the combined volume of the nozzle orifice 34 and the small funnel 56 is at least as large as the volume of a single droplet to be expelled.

Figure 5:
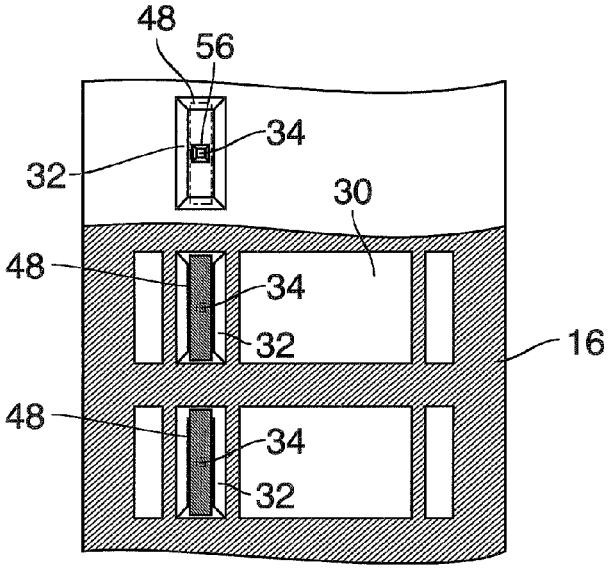
FIG. 5 is a partially broken-away top plan view of a multi-nozzle droplet ejection device.

FIG. 5 is a top plan view of a portion of a nozzle plate of a multi-nozzle droplet ejection device, showing three adjacent nozzle orifices 34. The configuration of the nozzle passage 32 corresponds to the one shown in FIG. 4. For the topmost of the nozzle orifices 34 in FIG. 5, the small funnel 56 and the tapered walls of the bottom part of the nozzle passage 32 are visible. The contour of the obstruction member 48 has been shown in phantom lines, showing that the obstruction member 48 extends transversely to the nozzle passage 32 over a width of the nozzle passage 32. As a result the through flow pattern 52 (shown in FIG. 4) is provided over the width of the nozzle passage 32.

For the two lowermost nozzle orifices 34 in FIG. 5, the nozzle plate 16 has been shown in cross-section, with the sectional plane passing through the cavities 30 (FIG. 1) underneath the pressure chambers. It will be understood that the flow direction of the ink in the flow passage 22 is from right to left in FIG. 5.

While the obstruction member 48 has been illustrated and described as a part of the ink distribution wafer 14, in an embodiment, the obstruction member 48 may be a part of the nozzle plate 16.

Figure 6:
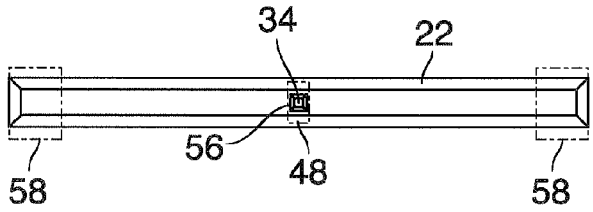
FIGS. 6 and 7 show a plan view and a sectional view of a device according to another embodiment.
Figure 7:
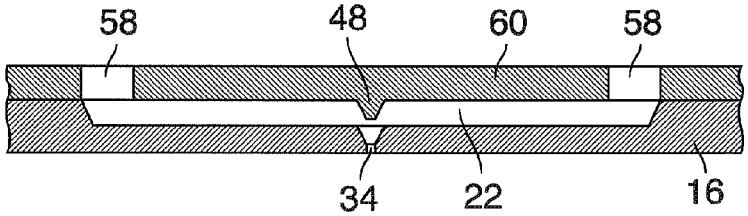

FIGS. 6 and 7 illustrate another embodiment where the flow passage 22 is configured as an elongated groove with downwardly tapering walls. The small funnel 56 and the nozzle orifice 34 are formed in the center of the bottom wall of that groove. The obstruction member 48 is arranged transversely in the groove that forms the flow passage 22. The opposite ends of the flow passage are connected to the pressure chamber 24 and to the outlet groove 20, respectively, via feed throughs 58 that are formed in a cover plate 60. As is shown in FIG. 7, the obstruction member 48 is formed by a downward projection at the bottom face of the cover plate 60, wherein the obstruction member 48 extends transversely to the flow passage 22 over the width of the flow passage 22. As a result the obstruction member 48 directs a through flow in the flow passage 22 towards the small funnel 56, including the nozzle orifice 34, over more than the width of the small funnel 56.

Figure 8:
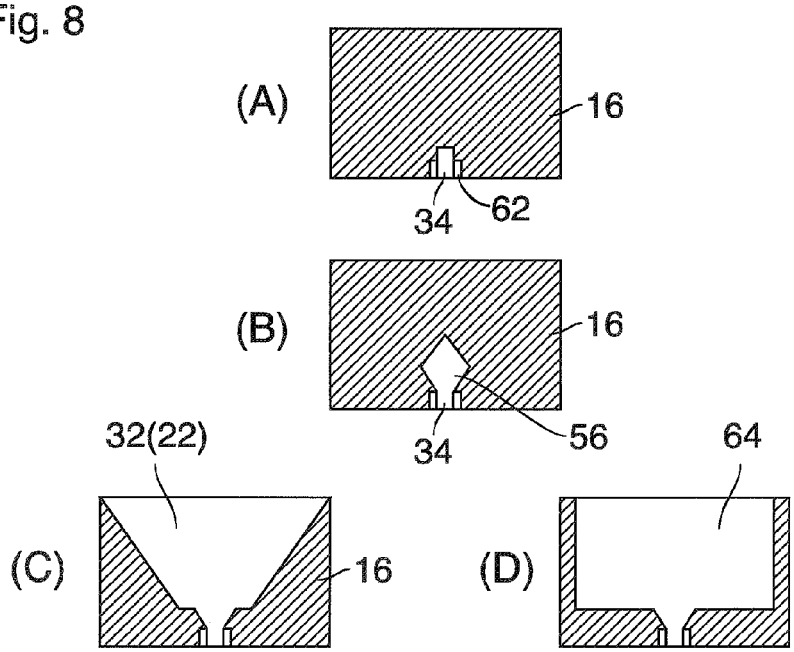
FIG. 8 is a diagrammatic illustration of processes for manufacturing a droplet ejection device.

FIG. 8 schematically illustrates methods of manufacturing the nozzle configurations shown in FIGS. 4 to 7. In a first step, shown in FIG. 8(A), a blind hole that is later to form the nozzle orifice 34 is etched into the bottom surface of the nozzle plate 16, and a passivation layer 62 is formed to protect the circumferential wall of the nozzle orifice 34.

Then, as is shown in FIG. 8(B), a cavity that is later to form the small funnel 56 is etched into the nozzle plate 16 by anisotropic wet etching. The etch process starts from the internal end of the blind hole that will form the nozzle orifice 34 and propagates along preferred crystallographic planes of the single crystal wafer that forms the nozzle plate 16. The crystallographic orientation of the wafer is selected such that a diamond shaped cavity is obtained. The surfaces of the cavity are oxidized so as to form a protection layer.

Then, as is shown in FIG. 8 (C) anisotropic wet etching (e.g. KOH etching) is applied from the top surface of the nozzle plate 16 so as to form the trapezoid shape of the nozzle passage 32 (FIGS. 4 and 5) or the flow passage 22 (FIGS. 6 and 7).

As an alternative, illustrated in FIG. 8(D), a dry etching process may be applied for forming a recess 64 with a rectangular cross-section.

The processes illustrated in FIG. 8 have the advantage that, since the wet etch process for forming the funnel 56 starts from the nozzle orifice 34, the funnel is precisely centered onto the nozzle orifice, which results in excellent droplet ejection properties of the nozzle. The position of the nozzle orifice 34 and the small funnel 56 relative to the recess 64 (or the passage 32 or 22) is less critical, so that this recess may be etched efficiently from the top surface of the wafer.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A droplet ejection device comprising:

a flow passage;

a nozzle orifice formed in a wall of the flow passage;

a circulation system for circulating a liquid through the flow passage; and an actuator system for generating a pressure wave in the liquid in the flow passage, wherein an obstruction member is arranged in the flow passage in a position opposite to the nozzle orifice and projecting towards the nozzle orifice, wherein the obstruction member extends transversely to the flow passage over the width of the flow passage, wherein the nozzle orifice is formed at an end of a nozzle passage that branches off from the flow passage, wherein the obstruction member is configured to force circulating liquid to flow through the nozzle passage along the nozzle orifice for removing contaminating particles and air bubbles in the vicinity of the nozzle orifice, and wherein the obstruction member extends into the nozzle passage over a width of the nozzle passage.

2. The device according to claim 1, wherein at least a portion of the nozzle passage adjoining the nozzle orifice is funnel-shaped.

3. The device according to claim 1, wherein at least a part of the flow passage or the nozzle passage is configured as a recess formed in a first face of a substrate, and the nozzle orifice is formed in a second face of the same substrate, opposite to said first face, and the nozzle orifice is connected to a bottom wall of the recess via a funnel that is centered onto the nozzle orifice.

4. The device according to claim 1, wherein at least a portion of the flow passage extends in parallel with a nozzle plate in which the nozzle orifice is formed, and said flow passage includes a pressure chamber that is exposed to the actuator system.

5. The device according to claim 4, wherein the pressure chamber is delimited by a flexible membrane on which a bending-type actuator is disposed.

* * * * *